US006272953B1

(12) United States Patent
Kant

(10) Patent No.: US 6,272,953 B1
(45) Date of Patent: Aug. 14, 2001

(54) CLEAT TOOL FOR ATHLETIC SHOE

(76) Inventor: Stephen D. Kant, 2159 Grange Ave., Highland Park, IL (US) 60035

( * ) Notice: Subject to any disclaimer, the term of this patent is extended or adjusted under 35 U.S.C. 154(b) by 0 days.

(21) Appl. No.: 09/417,931

(22) Filed: Oct. 13, 1999

(51) Int. Cl.[7] ..... B25B 23/00

(52) U.S. Cl. ..... 81/461; 81/185; 81/DIG. 11; 81/124.5

(58) Field of Search ..... 81/461, 185, DIG. 11, 81/442, 448, 124.4, 124.5, 441, 176.1, 176.15, 176.2, 176.3; 36/134

(56) References Cited

U.S. PATENT DOCUMENTS

| | | | | |
|---|---|---|---|---|
| 3,082,549 | | 3/1963 | Dolcemore . | |
| 4,035,934 | | 7/1977 | Hrivnak . | |
| 4,706,394 | | 11/1987 | Regula . | |
| 4,887,498 | | 12/1989 | Zayat . | |
| 5,033,211 | | 7/1991 | Latraverse et al. . | |
| 5,193,420 | * | 3/1993 | Smith | 81/185 X |
| 5,460,064 | | 10/1995 | Zayat, Jr. . | |
| 5,533,282 | | 7/1996 | Kataoka et al. . | |
| 5,622,090 | | 4/1997 | Marks . | |
| 5,623,774 | | 4/1997 | Abbey . | |
| 5,644,959 | | 7/1997 | Howard . | |
| 5,655,317 | | 8/1997 | Grant . | |
| 5,727,340 | | 3/1998 | Suk . | |
| 5,791,209 | | 8/1998 | Marks . | |
| 5,806,385 | | 9/1998 | Schupp . | |
| 5,829,328 | | 11/1998 | Chen . | |
| 5,865,078 | * | 2/1999 | Langford | 81/461 X |
| 6,053,078 | * | 4/2000 | Parker et al. | 81/461 |

FOREIGN PATENT DOCUMENTS 632239 1/1962 (IT) .

* cited by examiner

*Primary Examiner*—D. S. Meislin
(74) *Attorney, Agent, or Firm*—Fitch, Even, Tabin & Flannery

(57) ABSTRACT

A tool for rotating athletic shoe cleats having an annular body with gripping projections extending from one side thereof, a threaded shank extending from an opposing side thereof, and torquing openings adapted to receive prongs of a conventional cleat tool. The turning tool is able to thread the cleats into and out from internally threaded openings of an athletic shoe to provide fast cleat change-out operations. The tool includes an elongate sleeve having a cylindrical inner surface for mating over the annular cleat body, the sleeve having proximate and distal ends and a longitudinal axis extending therebetween; a plurality of pins individually mounted in dense, parallel disposition within the sleeve, the pins having a circular cross-sectional shape with a predetermined diameter that is sized for fitting in the torquing openings of the cleat body; and biasing mechanisms associated with respective ones of the plurality of pins for urging the associated pins along the longitudinal axis to an extended position and allowing the pins to be independently shifted so that, with the sleeve distal end mated over the cleat body, pins aligned with the torquing openings are biased therein and pins adjacent the cleat gripping projections securely engage thereagainst as the tool is rotated, thereby increasing torquing surface beyond what is provided merely by the pins in the torquing openings. The increased torquing surface provides improved gripping action between the tool and the cleat, thereby minimizing the risk of having the tool slip off the cleat during cleat change-out operations.

10 Claims, 3 Drawing Sheets

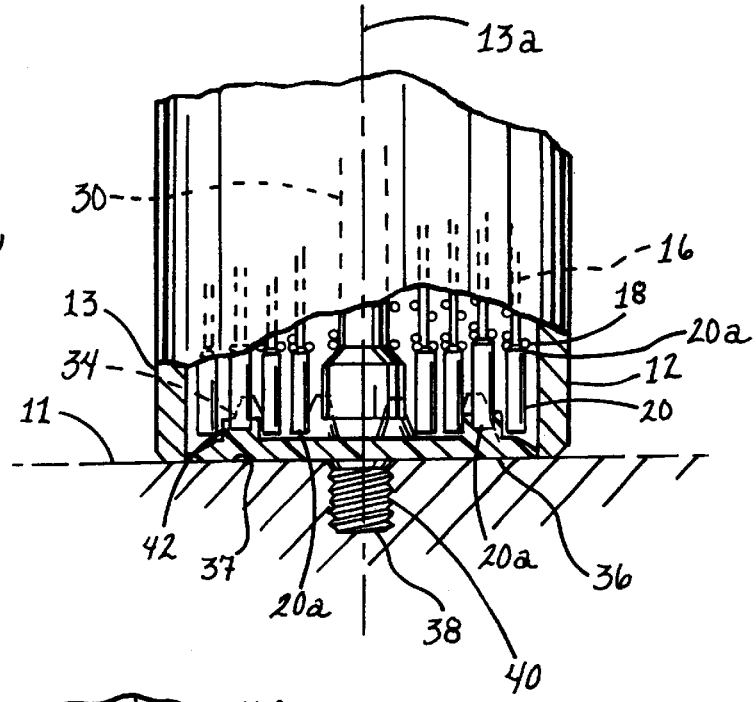
Fig. 4
Fig 5
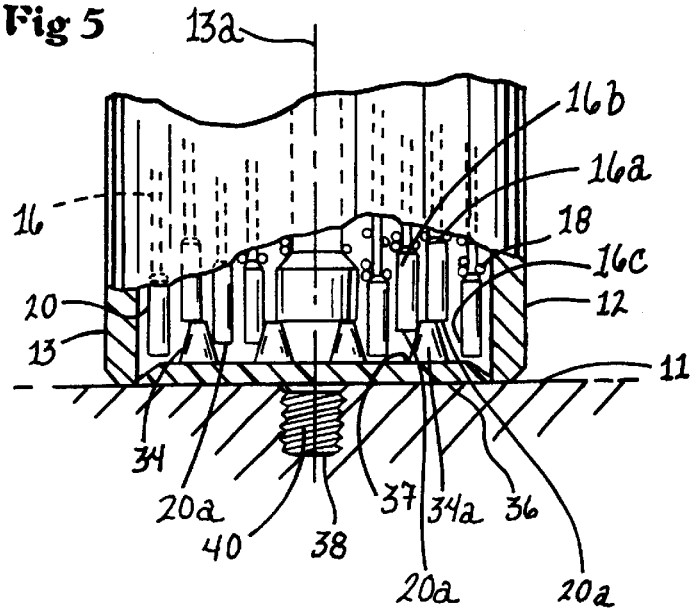
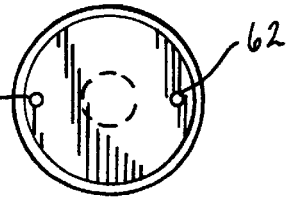
Fig. 6A
(PRIOR ART)
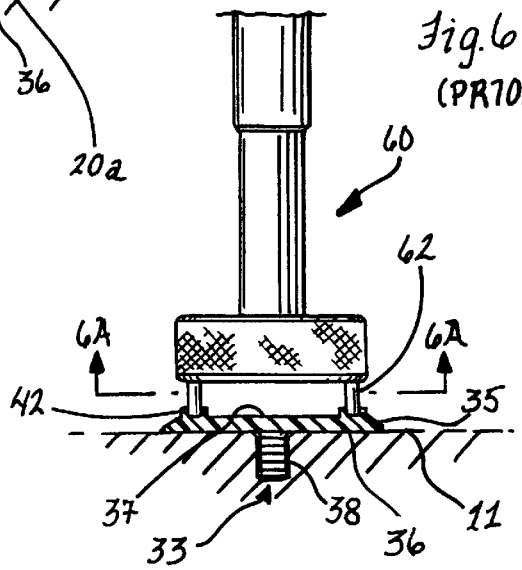
Fig. 6
(PRIOR ART)

CLEAT TOOL FOR ATHLETIC SHOE

BACKGROUND OF THE INVENTION

In recent years the golf world has seen a radical change with regard to acceptable and preferred footwear on golf courses. While metal-spiked shoes used to be preferred nearly unanimously, and were sometimes even required, such shoes are now frequently forbidden. It is currently considered that cleats having one or more plastic, rubberized, synthetic, or composite projections are better for maintaining golf courses in playable condition, and, as such, a wide variety of cleated golf shoes are now available.

Cleats help provide sound footing for the golfer during his swing, as well as when he traverses the course. The particular cleat preferred by a golfer for a round of golf may depend upon, among other things, the type of terrain on the particular course and the weather among other factors. Additionally, a wide variety of cleats are being called for in sports other than golf Football players, for example, may wish to use different cleats depending upon whether they are playing on grass or artificial turf, whether the playing surface is wet or dry, or even depending upon what position they are playing at the time. For example, sometimes having many small projections is preferable while, other times, having fewer, longer projections is better. Obviously, to have access to optimal cleats for all situations would be very costly as it would be necessary to own and keep available a myriad of athletic shoes.

To enhance flexibility, therefore, many athletic shoes are now made with changeable cleats. Examples of such athletic shoes are shown in U.S. Pat. Nos. 5,033,211; 5,533,282; and 5,727,340. Such shoes often have internally threaded apertures on their bottoms for receiving external threads from individual cleats. Alternatively, such shoes may have unthreaded recesses nevertheless configured for rotatingly receiving correspondingly shaped insertable cleats such as by way of various cooperating cam or wedge surfaces. For ease of reference, these types of cleats will also be referenced as being threaded into or out from receiving recesses in the bottom of the shoe. In this manner, individual cleats can be rotated into or out of such apertures so that they are replaceable. In order to securely attach the removable cleats so they do not work their way loose from the shoe, however, such cleats generally need to be rotated tightly into their corresponding apertures so that they are not prone to rotate back out of position. To provide for higher torque rotation with golf cleats, for instance, cleats conventionally include two torquing openings, and a two-pronged tool is commonly used for engaging the torquing openings and rotating the cleats into and out of the apertures.

Such conventional two-pronged cleat changing tools have shortcomings. First, not all cleats have torquing openings compatible with all such tools. Second, even when compatible torquing openings are present, such as with most golf cleats, they typically get obstructed by dirt, mud and/or other debris which limit the ability of a user to properly register one or both of the prongs of the conventional tool in the torque openings in the cleat so that secure engagement between the tool and cleat is not achieved. As is apparent, this makes it very difficult to obtain the proper amount of torquing action for removing tightly installed cleats from the shoe.

Torquing openings can be less than fully accessible for a variety of reasons. As stated, it is very common for there to be dirt, sand, sod or other earthly material wedged into the torquing openings. Other times, the walls of the torquing openings have been partially or fully eroded away, either from normal usage wear or from wear attributable to prior uses of a conventional two-pronged tool. Thus, conventional two-pronged tools are often unable to effectively change such cleats.

With respect to golf cleats particularly, due to the switch to modem cleats which tend to wear more quickly than their all-metal predecessors, the need for golf cleat change-outs has increased dramatically in recent years. Typically, a clubhouse employee is performing these change-out operations for multiple pairs of golf shoes. Also, there are golfers who request such cleat change-outs when they arrive at the course so that the employee only has a short time in which to accomplish this task, such as the time it takes a golfer to check in and pay for his round until the time the golfer gets in a golf cart to go to the first tee or driving range. Thus, the change-out operations need to be done in a time efficient manner.

The person attempting to do the cleat change-outs quickly often loses sight of the need to have the prongs of the tool inserted as close to full depth in the torque openings as possible to insure that the tool does not slip off the cleat as the tool is rotated. This slip off problem is exacerbated due to the aforedescribed problem of fouling of the torque openings. Because the person typically directs a downward force on the tool toward the bottom of the shoe while rotating/torquing the tool, if one or both prongs slip out from the torquing opening(s), his hand is likely to engage the cleats in place on the shoe with some force, causing injury and slowing down the entire cleat change-out operation. On the other hand, requiring a worker to clean out the torquing openings on all the cleats and to carefully make sure the prongs are fully registered therein is not practical from a speed of change-out standpoint, and, as a result, does not usually occur.

Accordingly, there is a need for a tool that can perform change-out operations on removable cleats of an athletic shoe in a fast and safe manner. More particularly, a tool that allows a golf cleat to be rapidly replaced despite fouling of the torquing openings thereof would be desirable.

SUMMARY OF TH INVENTION

In accordance with the invention, a tool is provided for rapidly changing-out cleats on athletic shoes while maintaining a secure grip therebetween as torque is applied to the cleat during change-out operations. In this manner, the present tool avoids the problem of having the tool slip off the cleat which slows the entire change-out process and can potentially cause injury to the person changing the cleats over to a new or different type of cleat. In this regard, the tool is particularly well-suited for use with golf cleats which are the subject of frequent change-out operations, either to go from metal to plastic cleats or to replace worn plastic cleats. The present tool does not depend solely, as do prior tools, on substantially full depth registering of prongs in torque openings on the cleat. This way, the cleats can be changed out quickly and safely without sacrificing the amount of torque that can be placed on the cleat by the tool user. To this end, the tool uses specially sized pins that are biased in a sleeve having a cylindrical inner diameter adapted to mate about the annular body of the cleat. The pins are sized to be received in the torque openings; however, if the holes are obstructed by foreign matter the pins adjacent the cleat projections will still act to efficiently transmit the applied torque to the cleat. And since they are engaged with the cleat projections along their length, there is no danger of slipping in an axial direction relative thereto, as there is with prongs not properly or fully registered in the torque openings, so that the present tool stays in secure engagement with the cleat irrespective of blockages present in the torquing openings. In addition, the pins are preferably recessed in the sleeve to provide a space at the end thereof in which the cleat body can be received prior to encountering the ends of the pins. The recess allows a user to easily and readily locate the sleeve over the body prior to applying torque to the cleat to further improve speed of change-out operations with the present tool over prior pronged tools where the user has to carefully align the prongs with the corresponding cleat torquing openings for fitting therein.

In one form of the invention, the cleats have an annular body with gripping projections extending from one side of the body, an insertable portion extending from an opposing side of the body, and torquing openings adapted to receive prongs of a conventional cleat tool. The turning tool is able to thread the cleats into and out from internally threaded openings of an athletic shoe to provide fast cleat change-out operations. The tool includes an elongate sleeve having a cylindrical inner surface for mating over the annular cleat body. The sleeve has proximate and distal ends and a longitudinal axis extending therebetween. The tool includes a plurality of pins mounted in close proximity to adjacent pins within the sleeve. The pins have a circular cross-sectional shape with a predetermined diameter that is sized for fitting in the torquing openings of the cleat body. A biasing mechanism is provided to urge the pins along the longitudinal axis to an extended position. The biasing mechanism allows the pins to be independently shifted so that, with the sleeve distal end mated over the cleat body, pins aligned with the torquing openings can be urged therein and pins adjacent the cleat gripping projections securely engage thereagainst as the tool is rotated. Thus, increased torquing surface is provided, beyond what is provided merely by the pins in the torquing openings. The increased torquing surface provides improved gripping action between the tool and the cleat, thereby minimizing the risk of having the tool slip off the cleat during cleat change-out operations.

In another form, the tool includes a head portion for engaging individual cleats. The head portion includes a sleeve and a plurality of independently spring-biased pins disposed within and generally parallel to the sleeve. The spring-biased pins are for engaging surface projections on the individual cleats. The tool also includes a handle attached to the head portion for facilitating the application of torque to the head portion relative to the individual cleats.

Another aspect of the invention is a method of changing a cleat on an athletic shoe in a fast and safe manner. The method includes providing a sleeve with a plurality of pins sized to fit torquing openings in a body of the cleat, placing the sleeve over the cleat body such that the pins aligned with the torquing openings are urged into the torquing openings where the torquing openings are not obstructed or damaged, the pins aligned with the gripping projections retract/shift within the sleeve upon contacting the gripping projections, and the pins adjacent the retracted pins securely engage the gripping projections laterally, and rotating the sleeve so that the pins adjacent the retracted pins apply a torquing force on the gripping projections sufficient to relatively insert the cleat into the athletic shoe aperture irrespective of whether the pins aligned with the torquing openings are disposed therein.

BRIEF DESCRIPTION OF THE DRAWINGS

FIG. 4 is an enlarged fragmentary elevation view of the head portion in FIG. 3 wherein the tool is applied to a cleat having torquing openings.

FIG. 5 is a view similar to FIG. 4 showing the tool applied to a cleat lacking torquing openings.

FIG. 6 is an elevational view of a prior art tool having a pair of prongs received in torquing openings of a cleat for applying and removing golf cleats from an athletic shoe.

FIG. 6A is a view taken along line 6A—6A of FIG. 6.

DETAILED DESCRIPTION OF THE PREFERRED EMBODIMENTS

Figure 2:
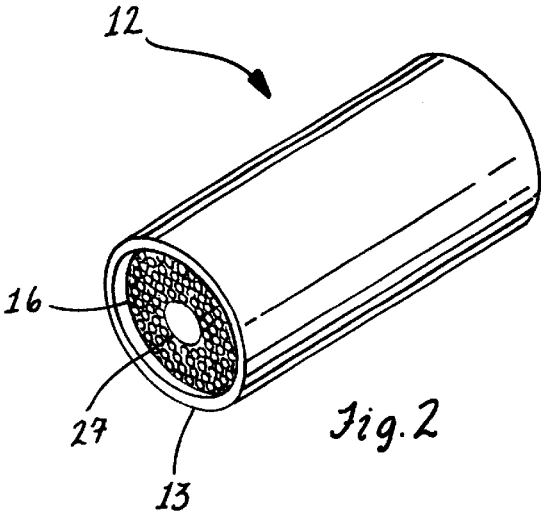
FIG. 2 is a perspective view of the tool showing a head portion including a sleeve having a cylindrical surface with a dense array of pins disposed inside the sleeve.
Figure 1:
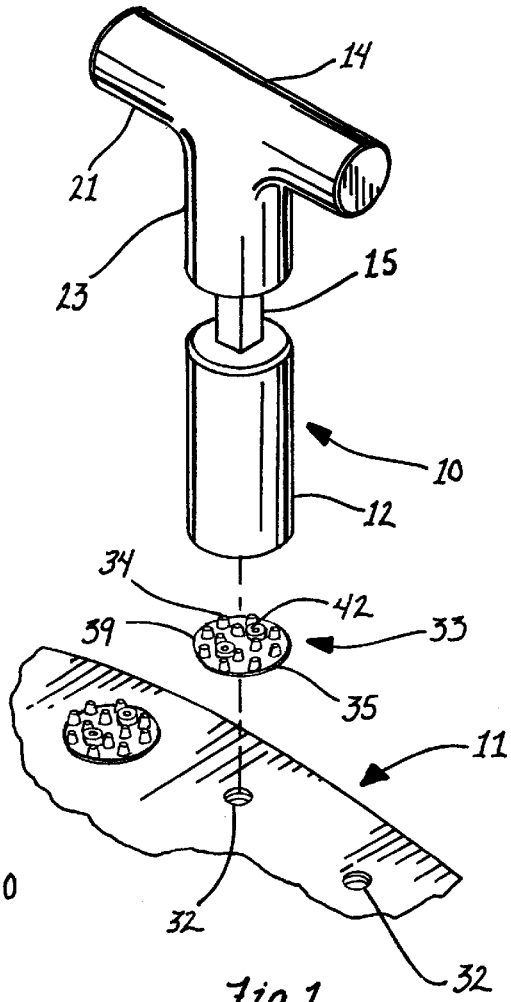
FIG. 1 is a perspective view of a cleat changing tool in accordance with the invention showing the tool in alignment with a cleat for installation on an athletic shoe.

An athletic shoe cleat tool 10 in accordance with a preferred form of the invention is shown in FIG. 1. The tool 10 which includes head portion 12, handle portion 14, and head-handle linkage 15 is depicted in axial alignment with a generally annular cleat 33 and an aperture 32 in an athletic shoe 11. The handle 14 is T-shaped for facilitating manually grasping the handle to apply the tool 10 to a cleat 33 needing to be applied or removed from an athletic shoe 11. The sleeve 13 of the head portion 12 (shown in greater detail in FIGS. 2–5), preferably fits along the periphery 39 of the annular cleat 33 when the tool 10 is applied to the cleat 33.

The cleat 33 (shown in cross-sectional detail in FIG. 4) can include a shank 38 having external threads 40 helically disposed thereon such that the shank 38 is insertable into an aperture 32 in the athletic shoe 11. The aperture 32 is thus preferably internally threaded in corresponding fashion with the external threading 40 on the shank 38. It should be noted that threaded cleats such as cleat 33 as well as cleats using other types of rotating fastening mechanisms (e.g., cam or wedge surfaces) can be installed or removed with the present tool 10.

The shank 38 extends from an upper surface 36 of the annular base or body portion 35 of the cleat 33. In this form, the upper surface 36 generally comes flush with the surface of the shoe 11 when the shank 38 of cleat 33 is fully received into the aperture 32. The lower surface 37 of the annular base portion 35 of the cleat 33 has surface projections 34 which depend therefrom, for gripping into the surface on which the cleats 33 are designed for use. The surface gripping projections 34 may include any non-flat surface features on the lower surface 37 of the cleat base 35. In an alternative form and as stated above, the cleat may include a cam or wedge or other insertable portion rather than the shank 38. Of course, the apertures of the shoe would be configured to rotatively engage with the alternative cleat.

As shown in FIGS. 2–5, the head portion 12 of the cleat tool 10 includes a generally cylindrical sleeve 13 having a longitudinal central axis 13*a*. The sleeve 13 preferably is cylindrical on its inner surface 13*b*, for reasons to be discussed hereinafter. Disposed within the sleeve 13 is a biasing mechanism, generally designated 100, which urges the distal pin contacts 20 to their extended position in the sleeve 13. The biasing mechanism 100 can take several forms and as shown includes a generally fixed and rigid spacer 22 having a number of apertures therein for retaining distinct, generally parallel axial members. In particular, the spacer 22 retains a number of pins 16 each having a pin shaft 24 defining its length, a pin contact 20 at a distal end of the pin shaft 24 and a pin retainer 26 at the opposite proximate end of the pin shaft 24. The pins are all preferably of equal length and are disposed densely and in parallel configuration to the axis of the cylindrical sleeve 13. The pins 16 are preferably retained in the sleeve 13 by having their pin retainers 26 disposed behind rigid pin spacer 22 while pin contact 20 is disposed in front of spacer 22. In this manner, the pin shafts 24 may slide through a particular corresponding aperture in pin spacer 22, but the pin 16 cannot slide out of such aperture because neither pin contact 20 nor pin retainer 26 fits through the aperture. Preferably, however, pin contacts 20 cannot slide so far as to contact the spacer 22 because the pin retainers 26 would contact the rear wall 17 at the proximate end of the head portion 12 before the contacts 20 met the spacer 22.

The biasing mechanism 100 employs helical pin springs 18 snaked about the shaft 24 of the pins 18. The pin spring 18 can extend from the shoulder 20*a* between the pin contact 20 and the pin shaft 24 to the pin spacer 22. The pin spring 18 thus has a maximum extension greater than the length of the shaft 24 between the spacer 22 and pin contact 20 so that the spring is prestressed in compression so as to push the pin contact 20 as far as possible from pin spacer 22. Thus, when the tool is not in use, the pin retainer 26 is flush with the rear side of pin spacer 22 and the pins are extended fully forward (toward the open/distal end of the head portion 12).

Figure 3:
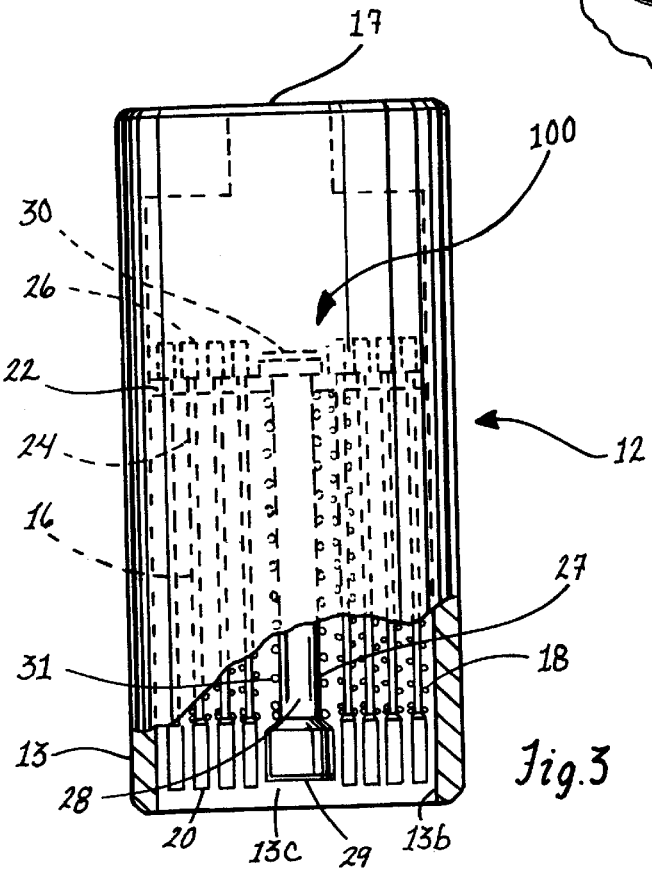
FIG. 3 is an elevational view of the head portion of FIG. 2 wherein a portion of the sleeve is broken away showing the pins urged to their extended position with distal ends of the pins recessed in the sleeve.

As the head portion 12 is shown in its unapplied state in FIG. 3, the pins 16 are extended uniformly fully forward within the sleeve 13 such that their contacts 20 define an engagement threshold for engaging surface projections 34 from the cleat 33. The engagement threshold, as shown in FIG. 3, is preferably recessed within the sleeve to permit the sleeve 13 to mate about the annular periphery 39 of the cleat 33 while the individual pin contacts 20 engage the surface projections 34 on the cleat 33, leaving some clearance for the thickness of the cleat base 35 via space 13*c* at the distal end of the sleeve 13. This allows the tool 10 to be readily located and fit over the annular cleat 33 prior to engagement of the pins therewith. Further, this present tool 10 does not require that pins 16 be specifically aligned with and located in torquing openings 42 of the cleat. This saves significant time during change-out operations with the tool 10 herein over the prior art tool 60, described more fully hereinafter.

The head portion 12 also can include a centrally disposed alignment member 27 axially oriented akin to the pins 16. Like the pins 16, the alignment member 27 preferably includes a contact 29 and a retainer 30 attached to opposite ends of a shaft 28. The alignment member 27 has a more robust construction than the pins 16 in that its shaft 28 and contact and retainer portions 29 and 30 at either end thereof are of a larger diameter than corresponding portions of the pins. Like the pins, the alignment member 27 is also disposed in an aperture in the spacer 22, and includes a helical spring 31 snaked around its shaft 28 and prestressed in compression between the contact 29 and the spacer 22. Although the alignment member 27 may be employed in the same manner as the pins 16, i.e. to engage surface projections 34 on the cleat 33, it may also function to align the central axis of the head portion with a center line of the annular cleat 33. Having aligned centers facilitates subsequently torquing the cleat 33 into or out from the aperture 32 in the athletic shoe 11, especially because lower torquing forces are typically required when the corresponding threads of the shank 38 and aperture 32 are properly aligned.

As the head portion 12 of the tool 10 is placed over the lower surface 37 and periphery 39 of a cleat 33, surface projections 34 engage one or more pin contacts 20 from respective pins 16, thereby pressing the pin contacts 20 toward the spacer 22 against their bias by varying degrees according to the profile of the lower surface 37 including the projections 34 extending therefrom. The pins 16 independently retract against the biases supplied by their respective pin springs 18 between their individual contacts 20 and the common spacer 22. While some of the pin contacts 20 may contact surface projections 34 that, at the point of contact, are generally parallel to the lower surface 37 of the cleat 33, other such contacts will likely contact surfaces which are obliquely angled, or even perpendicular to lower surface 37. These contacts are the ones through which direct, nonfrictional torque about the central axis can be applied to cleat via the projections 34 thereof The general configuration of engagement between the tool 10 and a cleat 33 immediately after the cleat has been torqued into an athletic shoe aperture or immediately before removal of the cleat 33 from such an aperture is about to begin is shown in FIGS. 4 and 5. In FIG. 4 the cleat includes conventional torquing openings 42 while in FIG. 5 the cleat lacks these openings. FIG. 4 shows that the pin contacts 20 are sized appropriately to fit into and engage the torquing openings 42 on cleats 33 that have such openings, especially when such openings are unobstructed and are well defined by uneroded surrounding structure. Most torquing openings for golf cleats are appropriately 2 mm in diameter. Accordingly, the pin contacts 20 are sized to be slightly smaller than 2 mm in diameter for fitting in the openings 42 such as on the order of approximately 1.75–1.8 mm in diameter. Other surface projections 34 on cleats having torquing openings 42 are also engaged by one or more pin contacts 20.

In the position described, the sleeve 13 preferably comes flush with the bottom (shown face up in FIGS. 4 and 5) of the athletic shoe 11 while simultaneously coming flush with the periphery 39 of the annular base portion 35 of the cleat 33. As most golf cleats are approximately 21–23 mm in diameter, the diameter of the sleeve inner cylindrical surface 13*b* is preferably about 24 mm to provide a mating fit about the annular cleat body.

The pins 16 and the alignment member 30 are engaged with whatever surface projections 34 (including torquing openings 42 when possible) they encounter from the cleat 33, biasing these members against their respective springs (18 and 31, respectively). Depending upon the amount of recess of the engagement threshold within the sleeve 13, any pin contacts 20 that do not encounter surface projections may or may not reach the cleat, as shown in FIG. 4, for example.

As is apparent, during cleat change at operations, the distal ends 20*a* of the pin contacts 20 can be disposed at a wide variety of spacings or levels relative to the distal end of the sleeve 13 due to the changing profile of the cleat 33. For instance, the pin ends 20*a* are disposed at three different levels during torquing of the cleat 33 in FIG. 5 with pin 16*a* retracted furthest as it sits on the bottom of the cleat projection 34*a,* whereas pin 16*b* is retracted less than pin 16*a* as it is engaged with the side of the projection 34*a,* and pin 16*c* is not retracted as its end 20*a* is adjacent the lower surface 37 of the cleat body 35. Accordingly, it has been found that the use of independently biased pins 16 in the tool 10 herein is advantageously utilized with cleats 33 since their profile changes often in a radical fashion between relatively closely adjacent points thereon. The tool 10 does not apply direct torque to the body 35 of the cleat 33 but instead uses its pins 16 against projections 34 of the cleat 33 supplemented by pins 16 in the torquing openings 42 to apply torque to the cleat 33. Thus, the advantage conferred by the tool 10 is not in its ability to handle differently shaped cleat bodies such as those that may have other than annular configurations, but instead is in the ability to handle cleats 33 with projections 34 generally since it does not matter how the tool 10 addresses the cleat 33 once mated thereover, and to handle cleats 33 having different arrangements and sizes of projections 34 thereon. It is noted that the pin engagement with the projections 34 will generally provide a much greater surface contact area across which torque can be applied than the pins in the openings afford. To this end, the present tool 10 operates effectively irrespective of whether the pins 16 are fully or even partially received in the openings, such as when these openings are fouled due to use of the cleat.

With some of the pins 16 obliquely contacting surface projections 34, and preferably the head portion 12 and cleat 33 in axial alignment, the tool is ready to be torqued to rotate the threaded cleat 33 within the aperture 32 of the athletic shoe 11. Torque may be applied to the head portion 12 in a variety of ways. FIG. 1 shows a T-shaped actuator handle 14 axially connected to the head portion 12 by a socket type head-handle linkage 15. With the T-shaped handle, the user can manually grip the crossbar portion 21 of the handle 14 with his fingers and, once the tool is engaged with the cleat, turn his wrist to rotate the handle 14 about the common axis of the cleat, head portion 12, and stem portion 23 of the handle portion 14. The torque applied to the handle 14 is transmitted to the head portion and cleat via linkage 15.

Preferably, the pins 16 are densely arranged so that they can encounter more surface projections 34 on the cleat 33, but preferably there is a small amount of transverse play at the contacts 20 such that when the head portion 12 is torqued, the pins 16 can skew slightly with respect to the central axis of the sleeve 13 (oppositely to the direction of torquing) before transferring maximum torque to the cleat 33. The transverse play of the pin contacts 20 permits the contacts 20 to generally get firmer engagement with the oblique and perpendicular surface projections and permit more torque to be applied to such projections without the tool 10 slipping off the cleat 33.

Figure 7:
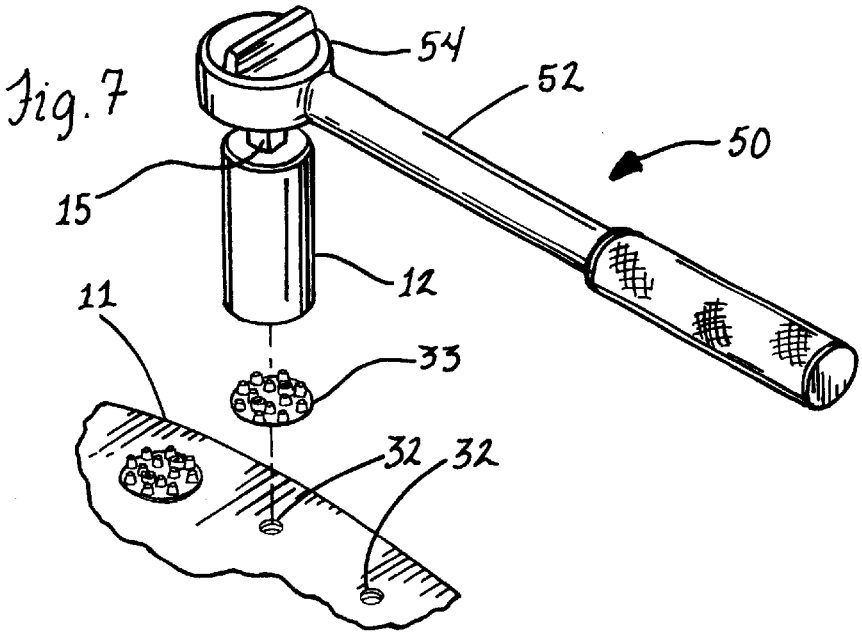
FIG. 7 is a perspective view showing a ratchet actuator handle for the tool of the present invention.
Figure 8:
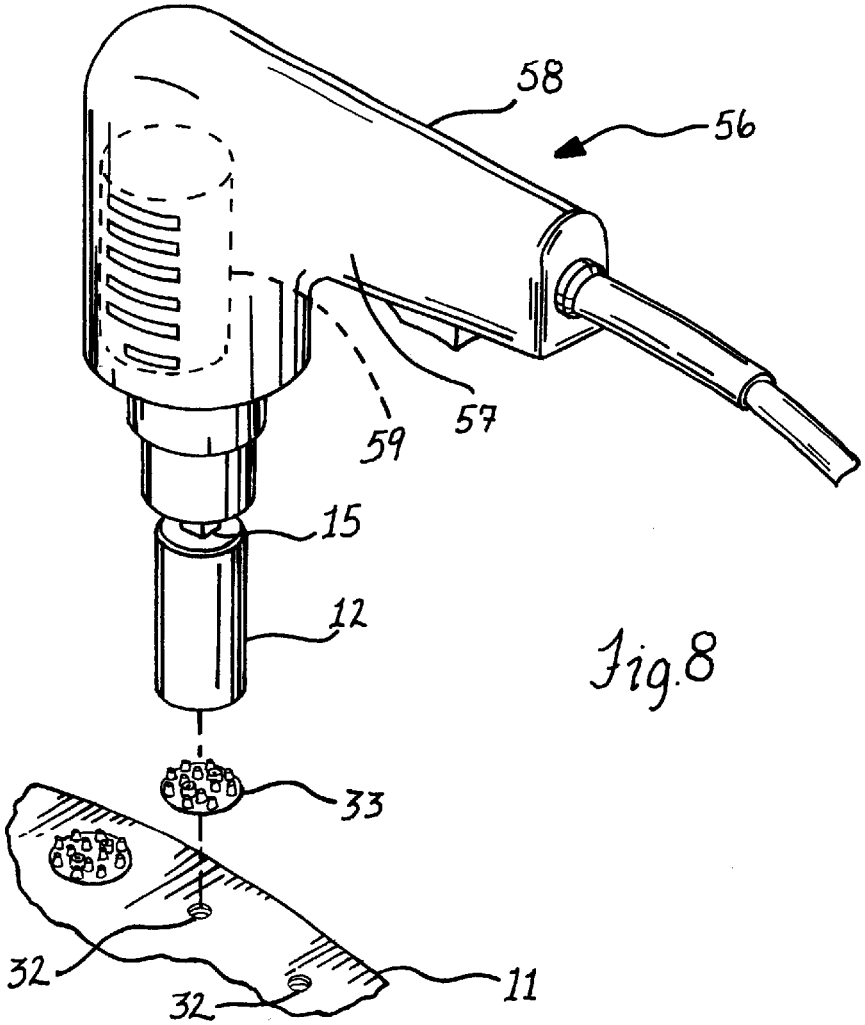
FIG. 8 is a perspective view showing a power actuator for the tool of the present invention.

Other means for torquing the head portion 12 and cleat 33 are shown in FIGS. 7 and 8, which show a ratchet handle actuator tool 50 and a power actuator tool 56, respectively. The ratchet handle tool 50 of FIG. 7 includes a lever arm 52 radial to the central axis of the head portion 12 whereby torque can be applied to the linkage 15 and the head portion 12 by tangentially directed force applied to the lever arm 52. The ratchet portion 54 of the tool permits the lever arm 52 to be rotated backwardly into a position easily accessible to the user without substantially torquing the linkage 15 in the backward direction for either application or removal of the cleat 33.

The power tool 56 of FIG. 8 has a power actuator 57 for rotating the head portion 12 via socket connection 15 and can include an electrically driven motor 59 within a casing 58. As shown, the motor 59 can be axially aligned with linkage 15. Preferably the tool 56 has an on/off switch and/or a forward/reverse switch for the motor. The tool 56 may draw AC power from a standard wall outlet (cord shown in FIG. 8) or may alternatively employ one or more battery cells for power.

FIGS. 6 and 6A show a conventional prior art tool 60 that is commonly used to apply and remove cleats 33 from a golf shoe 11. The tool 60 includes a pair of prongs 62 for engaging in torquing openings 42 on the cleats 33. The tool can then be rotated manually to apply or remove the cleat 33. As previously described, these tools 60 limit the ability of a person to quickly and safely perform cleat change-out operations. First, both of the prongs 62 of the tool 60 have to be carefully aligned over the openings 42 prior to insertion therein. Second, even after alignment, the prongs 62 may not be received to sufficient depth in the openings 42 due to fouling thereof If the openings 42 are tightly and fully packed with mud or dirt, they have to be cleaned out. If partially filled, the prongs 62 may not stay securely received therein once torquing begins in a change-out operation.

An advantage of the inventive tool 10 over such conventional tools 60 is that the tool 10 has spring-biased pins 16 that can engage a wide variety of surface projections that might exist on a given cleat. Thus, if a cleat lacks conventional torquing openings 42, or if those openings are obstructed, damaged or otherwise inaccessible, the tool 10 can still engage the cleat in a manner to permit sufficient gripping action and torque to be applied to the cleat in order to apply it to or remove it from an athletic shoe.

While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

What is claimed is:

1. In combination, cleats for being removably attached in openings of a bottom of an athletic shoe and an athletic shoe cleat tool for facilitating the rotational application and removal of individual ones of the cleats on an athletic shoe, said combination comprising:

an annular body of each of the cleats having a pair of openings of a predetermined size and an insertable portion for being received in the shoe bottom openings;

a plurality of projections extending from the body oppositely to the insertable portion and being configured for gripping into a surface with the cleats attached to the shoe; and a head portion of the tool for engaging individual cleats, said head portion including a sleeve and a plurality of independently spring-biased pins disposed within and generally parallel to said sleeve for engaging the projections of individual cleats, the pins each having a distal end portion with a predetermined diameter sized to fit into the annular body openings.

2. The combination in accordance with claim 1 wherein said pins have diameters of approximately 1.75–1.8 mm and the conventional size of the diameter of the torquing openings is approximately 2 mm.

3. The combination in accordance with claim 1 wherein said head portion further includes a central longitudinal alignment member generally parallel with said sleeve for engaging with predetermined surface projections on the individual cleats for facilitating rotational alignment of said tool with the individual cleats when said head portion is engaged therewith.

4. The combination in accordance with claim 1 wherein said spring-biased pins of said head portion are recessed within said sleeve.

5. The combination in accordance with claim 1 including a handle having a generally T-shape, with a stem and a crossbar, the stem being generally coaxial with the sleeve and attached to the head portion for rotation of an engaged individual cleat by transferring torque applied to the stem at the crossbar to said head portion in order to torque the head portion with respect to the engaged individual cleat.

6. The combination in accordance with claim 1 including an actuator attached to the head portion for applying torque to the cleats via the head portion, and the actuator includes a lever arm with respect to the longitudinal axis of said sleeve, said handle facilitating rotation of an engaged individual cleat by transferring force applied transversely on said lever arm to said head portion in order to torque said head portion with respect to the engaged individual cleat.

7. The combination in accordance with claim 1 wherein said sleeve is generally cylindrical and the individual cleats have a generally annular base portion and said sleeve generally fits around the individual cleat base portions during engagement therebetween.

8. The combination in accordance with claim 7 wherein the individual cleats have a generally annular body having a diameter of approximately 21–23 mm and said sleeve has a cylindrical inner surface having a diameter of approximately 24 mm for mating over the annular cleat bodies.

9. The combination in accordance with claim 1 including a power actuator for rotating the head portion and, thereby, to the individual cleats such that the individual cleats may be applied to and removed from the athletic shoe with electrical power.

10. The combination in accordance with claim 1 wherein said sleeve includes a cylindrical inner surface sized to tightly fit about the cleat annular body.

* * * * *